US010726857B2

(12) United States Patent
Birchall

(10) Patent No.: US 10,726,857 B2
(45) Date of Patent: Jul. 28, 2020

(54) SIGNAL PROCESSING FOR SPEECH DEREVERBERATION

(71) Applicant: Cirrus Logic International Semiconductor Ltd., Edinburgh (GB)

(72) Inventor: Tom Birchall, London (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/903,688

(22) Filed: Feb. 23, 2018

(65) Prior Publication Data

US 2019/0267018 A1 Aug. 29, 2019

(51) Int. Cl.
*G10L 21/0208* (2013.01)

(52) U.S. Cl.
CPC ..... *G10L 21/0208* (2013.01); *G10L 2021/02082* (2013.01)

(58) Field of Classification Search
None
See application file for complete search history.

(56) References Cited

U.S. PATENT DOCUMENTS

| | | | | |
|---|---|---|---|---|
| 9,646,592 | B2 | 5/2017 | Oyno et al. | |
| 2006/0115095 | A1* | 6/2006 | Giesbrecht | H04M 9/08 381/66 |
| 2010/0211382 | A1* | 8/2010 | Sugiyama | H04B 3/23 704/205 |
| 2014/0270216 | A1* | 9/2014 | Tsilfidis | H04R 3/002 381/66 |
| 2015/0149160 | A1* | 5/2015 | Lou | G10L 21/0208 704/226 |

FOREIGN PATENT DOCUMENTS

WO 2015165539 A2 11/2015

OTHER PUBLICATIONS

Combined Search and Examination Report under Sections 17 and 18(3), UKIPO, Application No. GB1809609.9, dated Dec. 11, 2018.

* cited by examiner

*Primary Examiner* — Antim G Shah
(74) *Attorney, Agent, or Firm* — Jackson Walker L.L.P.

(57) ABSTRACT

Audio signal processing techniques are described which are employed within a circuit of a speech dereverberation system. The amount of data or number of samples input to a reverberation coefficient determination unit is determined, taking into account information about the background noise in the acoustic space and information about energy of reverberant sound in the acoustic space.

17 Claims, 7 Drawing Sheets

Fig. 8

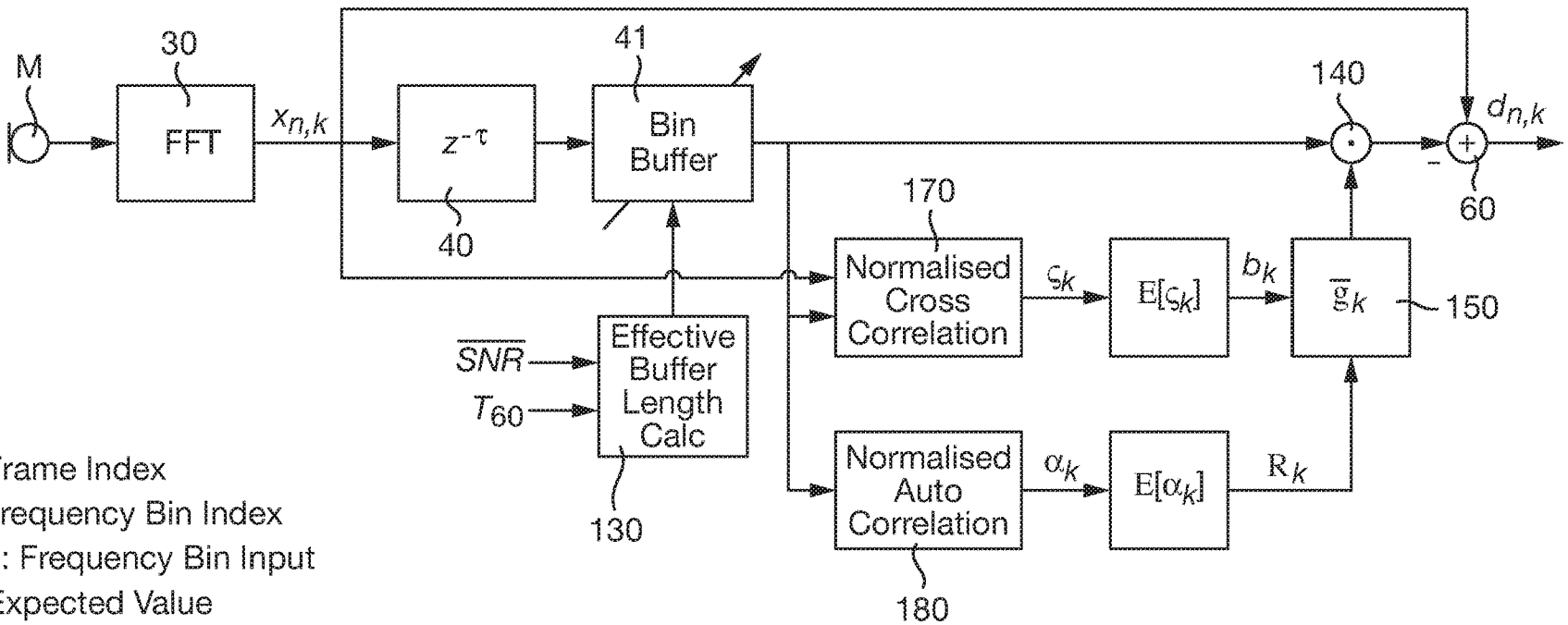

$n$: Frame Index
$k$: Frequency Bin Index
$x_{n,k}$: Frequency Bin Input
$\mathbb{E}$: Expected Value
$\alpha_k$: Normalised Auto-correlation
$\varsigma_k$: Normalised Cross-correlation
$R_k$: Expected Value of $\alpha_k$
$b_k$: Expected Value of $\varsigma_k$
$\overline{g}_k$: Reverberant Regression Vector Coefficients
$d_{n,k}$: dereverberated Frequency Domain Output $n$: Frame Index
$k$: Frequency Bin Index
$x_{n,k}$: Frequency Bin Input
E: Expected Value
$\alpha_k$: Normalised Auto-correlation
$\varsigma_k$: Normalised Cross-correlation
$R_k$: Expected Value of $\alpha_k$
$b_k$: Expected Value of $\varsigma_k$
$\bar{g}_k$: Reverberant Regression Vector Coefficients
$d_{n,k}$: dereverberated Frequency Domain Output

SIGNAL PROCESSING FOR SPEECH DEREVERBERATION

TECHNICAL FIELD

This application relates to techniques for speech dereverberation. In particular this application describes signal processing techniques for reducing the effects of reverberation when capturing speech signals in an acoustic environment.

BACKGROUND

Sound waves that are emitted from a source travel in all directions. Sound that is captured by a microphone in a given space will therefore comprise sound waves that have traveled on a direct path to reach the microphone, as well as sound waves that have been reflected from surfaces of the walls and other obstacles in the space. The persistence of sound waves after the sound source stops, and as a consequence of reflections, is called reverberation.

It will be appreciated that reflected or reverberant sounds captured by a microphone will have traveled on a longer path compared to the direct path and will therefore arrive after sound waves which have traveled on the direct path and at an attenuated level due to power being absorbed by surfaces and the extra distance traveled through the air. Thus, sound signals that are captured by a microphone in a real-world environment will contain multiple delayed and attenuated copies of the signal obtained via the direct path. Reverberations can be considered to be correlated delayed reflections of the source signal.

Speech signals derived from sounds that are captured by a microphone are used for many purposes including voice communication, recording and playback. Furthermore, applications which rely on voice control as a method of interacting with hardware and associated functionality are becoming more prevalent and many of these applications rely on Automatic Speech Recognition (ASR) techniques.

A typical ASR system configuration is illustrated in FIG. 1. Firstly, acoustic features which characterise essential features present in an input speech signal are extracted by an extraction unit 22 from a time frame of the speech signal. Then, on the basis of these features, the most likely text is identified by a decoding unit 23. The decoding unit may use a model, stored in a model storage unit 24, which comprises the knowledge required to decode the features into phonemes. The model is typically trained on a set of acoustic features that are extracted from an undistorted speech signal. Therefore if the input signal to the ASR system is corrupted by reverberant signals, then the recognition performance of the system is degraded.

It is therefore known that reverberation can result in a degradation in the intelligibility of speech signals that are captured by an acoustic sensor such as a microphone. Further, whilst speech recognition systems may perform well in conditions where the source to microphone distance is relatively small, the performance of speech recognition tends to degrade as the distance increases. In the field of home automation for example, where a smart home device operable to receive and process speech commands is typically placed within an acoustic environment such as an indoor room at some distance (e.g. 0.5 m to 6 m) from a user, the need for dereverberation of audio signals detected by the microphone of the device is particularly apparent.

Mitigating the effects of reverberation is therefore an important consideration in any application which utilises speech signals i.e. electric signals derived by an acoustic sensor in response to incident sounds which include speech. Reducing the effects of reverberation is therefore for important for improving the quality of voice calls and also in the context of applications utilising speech recognition systems.

A number of approaches to dereverberation have been proposed. For example, inverse filtering methods have been considered which are based on the principle of obtaining an inverse filter for the room or space, which is the cause of the reverberation, and deconvolving the captured signal with the inverse filter in order to recover the direct signal component. It will be appreciated that if the room impulse response (RIR) which describes the linear relation between the source and the microphone is known, then the inverse filter of the RIR can accurately recover the source signal. In most speech applications, however, the RIR is not known and must be estimated. The problem of estimating the RIR is compounded by the fact that the acoustic properties of the environment are potentially changeable i.e. not fixed.

A number of so-called "blind" dereverberation methods have been proposed in which attempts are made to estimate the inverse filter without prior knowledge of the room impulse response. In particular, some previously proposed reverberation techniques involve using a linear prediction based reverberation algorithm to estimate reverberant coefficients, wherein reverberant components may be from the input signal based on the estimated coefficients. Those in the art will understand that linear prediction refers to a mathematical operation in which future values of a discrete time signal are estimated as a linear function of previous samples.

Details of previously proposed linear prediction based dereverberation is described, for example, in:

1) "*Speech dereverberation based on variance-normalized delayed linear prediction*", T Nakatani et al, IEEE Trans. Audio, Speech and Language Processing, vol. 18, no. 7, pp. 1717-1731, September 2010. In this document an approach for blind speech dereverberation based on multichannel linear prediction (i.e. a multichannel autoregressive model (MCLP)) has been proposed.

2) "*Blind speech dereverberation with multi-channel linear prediction based on short time Fourier transform representation*", T Nakatani et al, Proc. International Conference on Acoustics Speech and Signal Processing, Las Vegas, USA, May 2008, pp. 85-88. This paper describes an autoregressive generative model for the acoustic transfer functions and models the spectral coefficients of the desired clean speech signal using a Gaussian distribution. Dereverberation is then performed by maximum likelihood estimation of all unknown model parameters.

3) "*Suppression of late reverberation effect on speech signal using long-term multiple-step linear prediction*", IEEE Trans. Audio, Speech and Language Processing, vo. 17, no. 4, pp. 534-545, May 2009. In this paper a further delayed linear prediction method has been proposed.

It will be appreciated that in most real-world applications, for example in the context of a smart home device operable to receive and process speech commands, the level of background noise will vary over time. Unfortunately, despite improvements in the performance of dereverberation systems, previously considered techniques struggle to maintain a good performance in noise. Furthermore, previously proposed dereverberation systems, may experience issues such as speech suppression and distortion when subject to time-varying, noisy conditions. The low frequencies of speech are especially affected as this is where the longest reverberation times occur and where the lowest signal to noise ratios (SNR) arise.

Aspects described herein are concerned with improving the quality of speech signals derived by a dereverberation system. In particular, aspects described herein are concerned with improving dereverberation performance in noisy environments or in environments which experience time varying noise levels.

According to an example of a first aspect there is provided a signal processing circuit of a speech dereverberation system, the signal processing circuit comprising: a reverberation coefficient determination unit configured to determine one or more reverberation coefficients of a portion of an input signal generated by an acoustic sensor provided in an acoustic space; and a determination unit operable to determine a number of past samples of the portion of the input signal to be passed to the reverberation coefficient determination unit, based on:

i) information about the background noise in the acoustic space; and ii) information about energy of reverberant sound in the acoustic space.

The information about background noise in the acoustic space may comprise information about the SNR or NSR. The information about the energy of the reverberant sound may comprise the decay in the energy of the reverberant sound in the acoustic space. The information about the energy of reverberant sound may be determined from a representation of the room impulse response (RIR) for the acoustic space. The representation of the RIR may be estimated.

According to at least one example the determination unit may be operable to determine a threshold time at which a level of the reverberant energy falls below a predetermined value relative to a respective level of the noise. Alternatively or additionally, the determination unit is operable to determine a threshold time at which a level of the energy of the decaying reverberant sound is substantially equal to a level of the NSR. The threshold time may be selected to be the time at which the ratio of the level of reverberant sound energy to the level of the NSR is at or above a predetermined value. The number of past samples input to the dereverberation coefficient determination unit may thus be calculated based on the threshold time. The determination unit may be beneficially configured to determine a number of samples that will maintain or achieve a positive reverberant sound energy to NSR level ratio.

According to one or more examples the signal processing circuit further comprises a selection mechanism operable to select the number of samples of the input signal to be passed to the reverberation coefficient determination unit based on the number of samples determined by the determination unit. The selection mechanism may comprise an adjustable length buffer. Alternatively, the selection mechanism may be operable to cause adjustment of the number of samples that a processed by a correlation unit of the signal processing circuit.

According to an example of a second aspect there is provided a signal processing circuit comprising:

a determination unit operable to determine a number of samples of an input signal to be passed to a reverberation coefficient determination unit that will maintain or achieve a positive reverberant sound to noise ratio.

The signal processing circuit may further comprise a reverberation coefficient determination unit configured to determine one or more reverberation coefficients of a portion of an input signal generated by an acoustic sensor provided in an acoustic space.

According to one or more examples an inverse filter may be obtained from the reverberation coefficients determined by the reverberation coefficient determination unit. The inverse filter may be convolved with the portion of the input signal to obtain an estimate of the reverberant component of the portion. Furthermore, the estimate of the reverberant component of the portion may be subtracted, or deconvolved, with the input signal to give a dereverberated signal $d_{n,k}$.

A signal processing circuit as claimed in any preceding claim, wherein the reverberation coefficient determination unit determines the reverberation coefficients based on a linear prediction algorithm.

According to one or more examples the signal processing circuit may further comprise a delay unit configured to apply a delay to the input signal.

According to one or more examples the signal processing circuit may further comprise a Fast Fourier Transform (FFT) operable to the determine the amplitude of the input signal generated by the acoustic sensor in a plurality of frequency ranges, wherein the reverberation coefficient prediction unit is operable to determine the reverberant coefficients in one or more of the frequency ranges.

According to one or more examples the signal processing may be provided in the form of a single integrated circuit.

A device may be provided comprising the signal processing circuit according to an example of one or more of the above aspects. The device may comprise, inter alia: a mobile telephone, an audio player, a video player, a mobile computing platform, a games device, a remote controller device, a toy, a machine, or a home automation controller, a domestic appliance or a smart home device. The device may comprise an automatic speech recognition system. The device may comprise one or a plurality of microphones.

According to at least one example the signal processing circuit further comprises a beamformer configured to time align the plurality of microphones in a direction of incident speech sound.

According to an example of a further aspect there is provided method of signal processing comprising:

determining a number of samples of a portion of an input signal generated by an acoustic sensor provided in an acoustic space based on:

i) information about the background noise in the acoustic space; and ii) information about energy of reverberant sound in the acoustic space.

The method may comprise estimating at least one reverberation coefficient of the portion of the input signal.

According to another aspect of the present invention, there is provided a computer program product, comprising a computer-readable tangible medium, and instructions for performing a method according to the previous aspect.

According to another aspect of the present invention, there is provided a non-transitory computer readable storage medium having computer-executable instructions stored thereon that, when executed by processor circuitry, cause the processor circuitry to perform a method according to the previous aspect.

BRIEF DESCRIPTION OF DRAWINGS

For a better understanding of the present invention and to show how the same may be carried into effect, reference will now be made by way of example to the accompanying drawings in which:

FIG. 8 is a block diagram illustrating a processing system for carrying the processing method illustrated in FIG. 7;

DETAILED DESCRIPTION

The description below sets forth examples according to the present disclosure. Further example embodiments and implementations will be apparent to those having ordinary skill in the art. Further, those having ordinary skill in the art will recognize that various equivalent techniques may be applied in lieu of, or in conjunction with, the examples discussed below, and all such equivalents should be deemed as being encompassed by the present disclosure.

The methods described herein can be implemented in a wide range of devices and systems. However, for ease of explanation of one example, an illustrative example will be described, in which the implementation occurs in a smart home device utilising automatic speech recognition.

Figure 2:
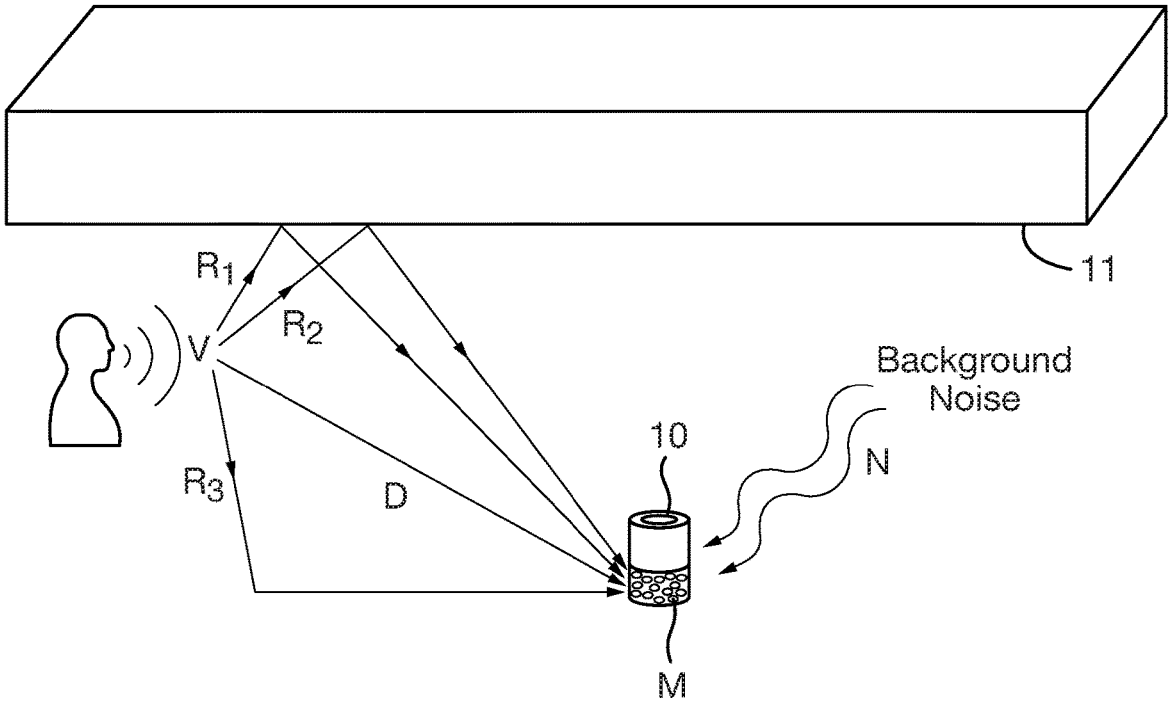
FIG. 2 illustrates an acoustic space comprising a smart home device 10.

FIG. 2 illustrates an acoustic space comprising a smart home device 10 having a microphone M for detecting ambient sounds. The microphone is used for detecting the speech of a user and may be typically located at a distance of greater than 0.5 m from the user. It will be appreciated that the smart home device may comprise multiple microphones, although this is not necessary for an understanding of the presently described example aspects.

Sound waves travel along a direct sound path D between a voice source V and the microphone M of the device. Sound waves also travel along a plurality of reverberant sound paths $R_{1 \ldots n}$, wherein the sound is reflected by the surface of a ceiling 11, or floor, of the acoustic space. It will be appreciated that numerous other reflected sound paths other than those illustrated will be set up following the emission of voice sound. The microphone will also detect background noise N arising within the space and the level of this noise may vary. It will be appreciated that noise is mostly additive and, in contrast to reverberation, is uncorrelated with speech.

Figure 1:
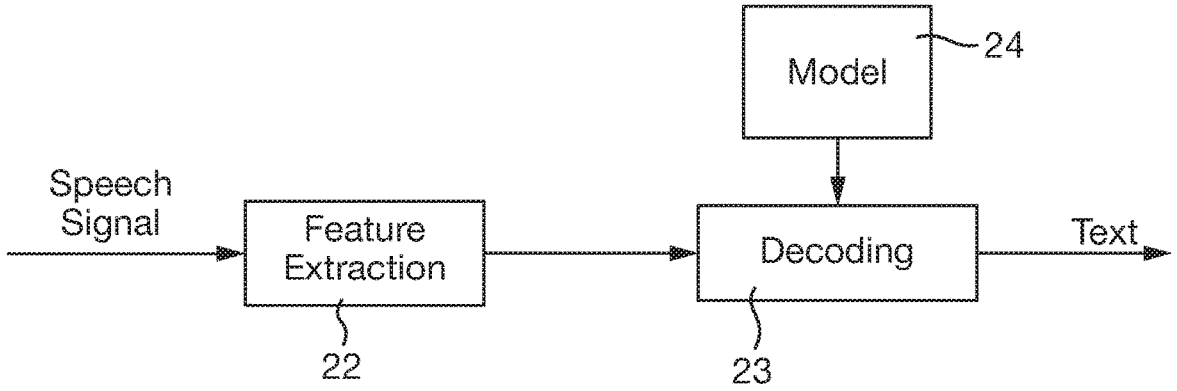
FIG. 1 illustrates a typical ASR system configuration.

The smart home device comprises circuitry for processing sound signals detected by the microphone. In particular, the smart home device 10 may comprise an Automatic Speech Recognition system such as the ASR system illustrated in FIG. 1. The device further comprises a dereverberation system operable to facilitate dereverberation of audio signals detected by the microphone M. The dereverberation system may be provided at the front-end of the ASR system. Thus, an audio input signal that is derived from a microphone in response to incident sounds including speech, can be processed to derive a dereverberated signal (i.e. a signal in which one or more components of reverberation have been removed) which may be input to an ASR system.

Speech that is captured by a microphone is generally assumed to consist of three parts: a direct-path response, early reflections and late reverberation. Early reflections may be defined as the reflection components that arise after the direct-path response within a time interval of about 30-50 ms, and the late reverberation as all latter reflections. It has been demonstrated that late reverberations are a major cause of the degradation of ASR performance and loss of speech intelligibility. In view of this, dereverberation systems may focus on estimating the late reverberation, in order to recover the anechoic signal (clean speech) together with the early reflections.

Considering this mathematically, and as set out an article entitled "Speech dereverberation using weighted prediction error with Laplacian model of the desired signal", by A. Jukic and Simon Doclo, we can consider a scenario where a single speech source in an enclosure is captured by M microphones.

Let $S_n$,k denote the clean speech signal in the SIFT domain with time frame index $n \in \{1, \ldots, N\}$, and frequency bin index $k \in \{1, \ldots, K\}$. The reverberant speech signal observed at the m-th microphone, $m \in \{1, \ldots, M\}$, is typically modelled in the SIFT domain as:

$$x_{n,k}^{m} = \Sigma_{l=0}^{L_h-1} (h_{l,k}^{m})^* S_{n-l,k} + e_{n,k}^{m} \tag{2}$$

Where $h_{l,k}^{m}$ models the acoustic transfer function (ATF) between the speech source and m-th microphone in the SIFT domain, the length of ATF equals $L_h$, and the (.)* denotes the complex conjugate operator. The additive term $e_{n,k}^{m}$ jointly represents modeling errors and the additive noise signal. The convolutive model in (2) is often rewritten as $$x_{n,k}^{m} = d_{n,k}^{m} + \Sigma_{l=D}^{L_h-1} (h_{l,k}^{m})^* s_{n-l,k} + e_{n,k}^{m} \tag{3}$$

where the signal $$d_{n,k}^{m} = \Sigma_{l=0}^{D-1} (h_{l,k}^{m})^* s_{n-l,k} \tag{4}$$

is composed of the anechoic speech signal and early reflections at the m-th microphone, and D corresponds to the duration of the early reflections. As previously mentioned, dereverberation methods often aim to recover the anechoic signal together with the early reflections, since the early reflections tend to improve speech intelligibility. Thus, $d_{n,k}$ is the desired or dereverberated signal.

In several methods it has been proposed to replace the convolutive model in (2) and (3) with an autoregressive model. The model has been further simplified by assuming $e_{n,k}^{m}=0$, $\forall$n, k, m. Under these assumptions, the signal observed at the first microphone (m=1) can be written in the well-known multi-channel linear prediction form:

$$x_{n,k}^{1} = d_{n,k} + \Sigma_{m=1}^{M} (g_k^{m})^H x_{n-D,k}^{m} \tag{5}$$

where $d_{n,k}$ is the desired signal, and $(.)^H$ denotes the conjugate disposition operator. The vector $g_k^{m} \in \mathbb{C} L_k$ is the regression vector of order $L_k$ for the m-th channel and $x_{n,k}^{m}$ is defined as $$x_{n,k}^{m} = [x_{n,k}^{m}, \ldots, x_{n-L_k+1,k}^{m}]^T \tag{6}$$

with $(.)^T$ denoting the transposition operator. The MCLP model (5) can be written in a compact form using the multi-channel regression vector $g_k \in \mathbb{C} ML_k$ $$x_{n,k}^{1} = d_{n,k} + g_k^H x_{n-D,k} \tag{7}$$

with the following notation:

$$g_k=[(g_k^1)^T, \ldots, g_k^m)^T]^T \quad (7)$$

$$x_{n,k}=[(x_{n,k}^1)^T, \ldots, (x_{n,k}^m)_T]^T \quad (8)$$

And where $x_{n,k}^1$ is the observed signal, $d_{n,k}$ is the desired signal and $g_k^H x_{n-D,k}$ represents the late reverberation.

Thus, the above derivation formulates the problem of speech dereverberation formulated as a blind estimation of the desired signal $d_{n,k}$, consisting of the direct speech signal and early reflections, from the reverberant observations $x_{n,k}^m$, ∀m, n, k.

It is reported that blind channel dereverberation using linear prediction holds exactly for the multi-channel case and is a good approximation for the single channel case. In theory, the room's convolutive system is invertible with a causal FIR filter in the time-domain only if the system is minimum phase, however, it has also been reported that clean speech spectral components may be well recovered with causal FIR filters in the time-frequency domain even when the room's convolutive system is non-minimum phase in the time-domain as it is assumed that frequency components are not correlated as each frequency bin acts is treated as a sub-band filter. Furthermore, the AR model has been confirmed to be effective for dereverberation experimentally.

It therefore follows that the multichannel formulation in (5) can be written in single channel form as:

$$d_{n,k}=x_{n,k}^1-g_k^H x_{n-D,k_n} \quad (9)$$

Figure 3:
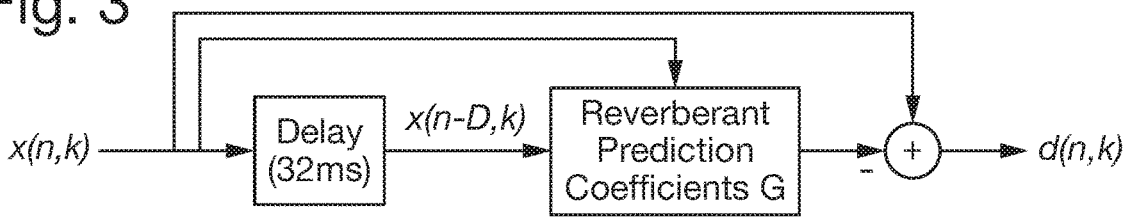
FIG. 3 provides a simplified illustrations of a dereverberation system.

FIG. 3 illustrates a schematic of an audio signal processing circuit in which reverberation coefficients are calculated and the reverberant component of speech is estimated and removed. Specifically, an input signal $x_{n,k}$ generated by a microphone M following detection of an incident sound is provided via a first branch to a reverberation coefficient prediction unit 50 operable to calculate one or more reverberant coefficients $g_k$.

The reverberation coefficients prediction unit 50 is operable to calculate predicted reverberant coefficients $g_k$ based on e.g. a linear prediction algorithm or an autoregressive modelling approach, which is performed in the short-time Fourier transform domain on a portion or frame of the input signal. The linear prediction algorithm may then enable an estimation of future reverberant components on the basis of one or more buffered frames of the input signal. The system may introduce a time delay at delay unit 40 so that the frames input to the reverberation coefficient prediction unit 50 allow an estimation of the later reverberations. The delay applied by the delay unit 40 may be, for example 32 ms, or may be some other amount of delay. The estimated coefficients are matrix multiplied with the buffered vector of previous frames to obtain an estimate of the reverberation for each frame n (not shown) and frequency bin. The estimated reverberant component of that respective frequency bin is then subtracted from the input signal at module 60 to output, in the frequency domain, a dereverberated signal $d_{n,k}$. It will be appreciated that the dereverberated signal may be represented by equation (9) above.

A dereverberation system may comprise a final stage (not shown) which uses spectral filtering techniques to remove the late reverberant component still present in the signal.

It will be appreciated that after a sound is produced reflections will build up and then decay as the sound is absorbed by the surfaces of the acoustic environment. Reflected sounds will eventually lose enough energy and drop below the level of perception. The amount of time a sound takes to die away is called the reverberation time. A standard measurement of an environment's reverb time is the amount of time required for a sound to fade by 60 dB. This time is often called RT60. It will be appreciated that other measurements of the reverberation time are also possible.

Figure 4A:
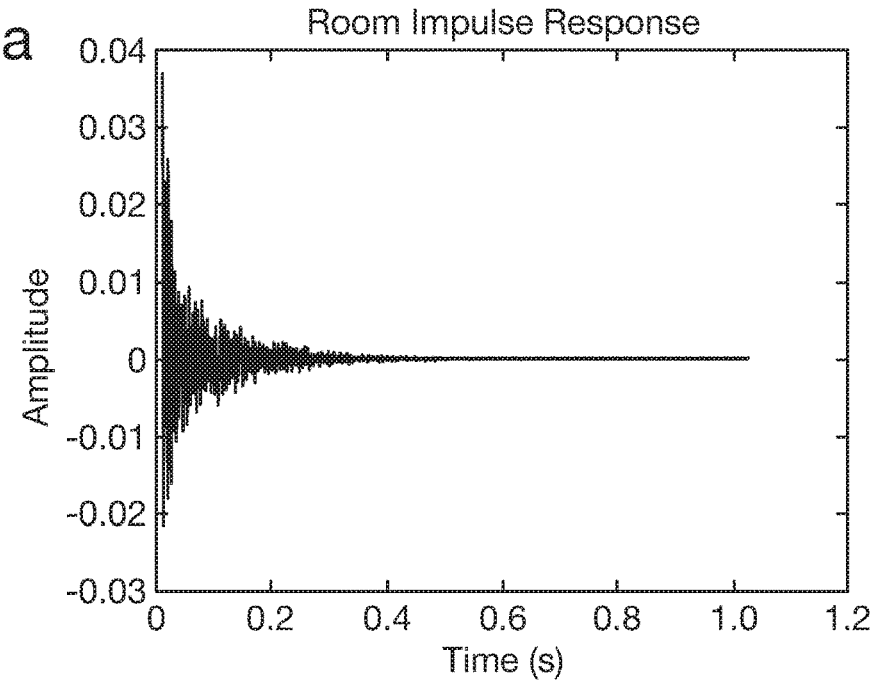
FIG. 4*a* illustrates the amplitude of a room impulse response (RIR) of an acoustic environment.
Figure 4B:
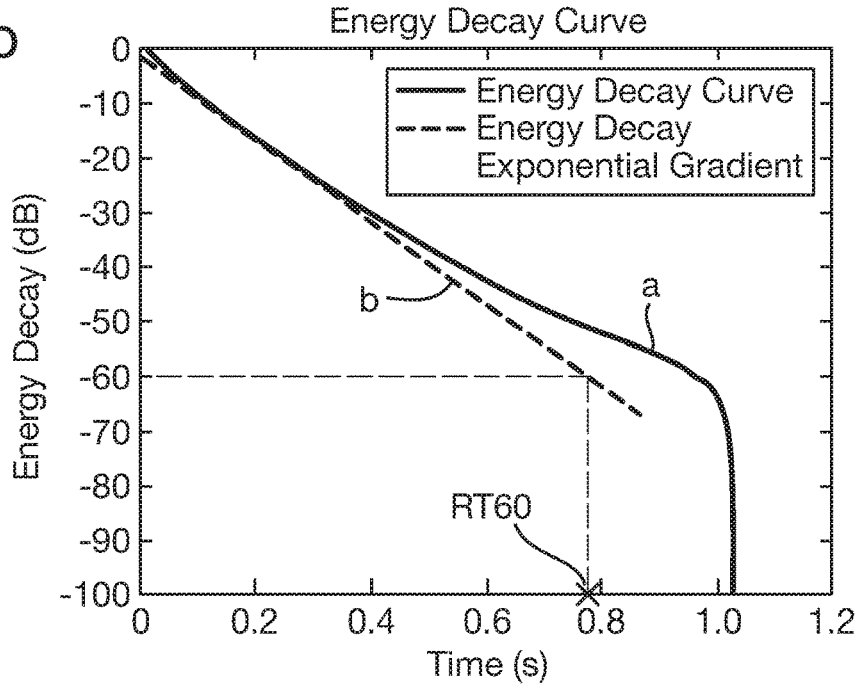
FIG. 4*b* illustrates the decay in the energy of a room impulse response.

FIG. 4*a* provides a graphical representation of a room impulse response (RIR) of an acoustic environment and plots the amplitude of an emitted impulse signal against time. FIG. 4*b* provides a graphical representation of the decay in the energy of the room impulse response and plots a) the energy of the room impulse response (RIR) as a function of time and b) an exponential gradient of the RIR. The exponential gradient may be considered to represent the amount of reverberation that is present in the environment following the production of a sound impulse and allows the reverberation time RT60—i.e. the time taken for the impulse to fade by 60 dB—to be obtained.

It will also be appreciated that a speech signal that is detected by a microphone will be infected by noise originating from various sources. Thus, past samples input to the reverberation coefficient prediction unit will typically also include a noise component. It will be appreciated that when noise is present in the microphone signal the dereverberation processing may lead to over estimation of the reverberant components which leads to speech suppression. The level of the background noise may be similar to, or may even exceed, the power of the reverberation.

Figure 5:
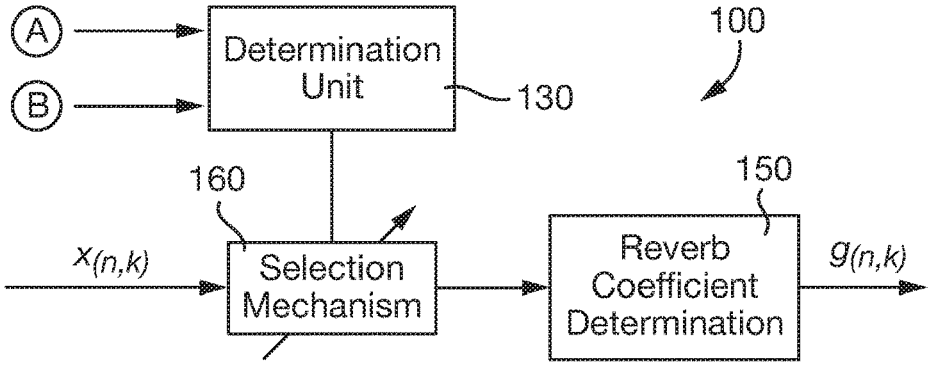
FIG. 5 illustrates a first example of a dereverberation system.

FIG. 5 illustrates a first example of a dereverberation system 100 according to the present aspects. The system may be provided as part of an audio signal processing system in a device, which may for example be a smart home device incorporating an automatic speech recognition system or a communication device.

The dereverberation system 100 comprises a reverberation coefficient determination unit 150 configured to receive a portion (e.g. one or more buffered frames) of an input signal x(n, k) and to derive one or more reverberant coefficients (e.g. at least one reverberant coefficient per frame of the portion). The dereverberation system further comprises a determination unit 130 which is operable to determine a number of past samples of the input signal that is to be passed to the reverberation coefficient determination unit 150.

The reverberant coefficients g(n, k) may be subsequently applied to the portion of the input signal in order to obtain an estimation of the reverberation (not shown). The reverberant component of that respective frequency bin is then subtracted from the input signal to give a dereverberated signal $d_{n,k}$.

According to the present example the determination unit 130 receives first and second control inputs.

The first control input A optionally represents the information about the background noise of the acoustic space, or may comprise information to allow the same to be determined (either by calculation or estimation). For example the first control input may comprise information about the SNR (signal to noise ratio), the NSR (Noise to Signal ratio) or information about the level of noise which may, e.g. be considered to be the noise floor (and which may be derived from the SNR). The information about the background noise may be obtained explicitly, i.e. based on a measured value of the SNR or noise floor, or may be estimated e.g. from an estimate or long term estimate of the SNR. According to at least one example the SNR is calculated directly in one of the previous blocks/frames. However, the instantaneous SNR is time varying so in order to get a more stable value of the SNR, a long term estimate is calculated using smoothing.

The second control input optionally represents information about the energy of reverberant sound in the acoustic space. For example, according to at least one example the second control input represents the decay in the power/energy of reverberant sound in the acoustic space as a function of time (the reverberation time RT60). This may be determined from a room impulse response (RIR) for the acoustic space, or may comprise information to allow the same to be determined.

Thus, according to one or more examples of the present aspects, the determination unit 130 is configured to derive a number of samples of the input signal that is provided to the reverberation coefficient determination unit 150 based on:

i) information about the background noise in the acoustic space; and ii) information about the power/energy of reverberant sound in the acoustic space.

The speech dereverberation system further comprises a selection mechanism or module 160 operable to implement the selection or adjustment of the appropriate number of samples, or past samples, of the input signal to be passed to the reverberation coefficient determination unit based on the number of samples determined by the determination unit. It will be appreciated that the selection of the appropriate number of samples may be implemented in a number of ways. For example, by providing a variable buffer prior to the reverberation coefficient determination unit 150 which is configured to allow the length of a buffer to be adjusted. It will be appreciated that signal processing systems may comprise one or more correlation units operable to correlate the input signal or a segment of the input signal against another signal. Thus, it will be appreciated that rather than varying the amount of data stored in the buffer, the amount of data that is processed by one or more correlation units of the signal processing circuit may instead be adjusted. In this sense, examples described herein may refer to a variable effective buffer length, wherein the amount of data stored in a buffer may be varied or the amount of buffered data processed may be varied.

Figure 6A:
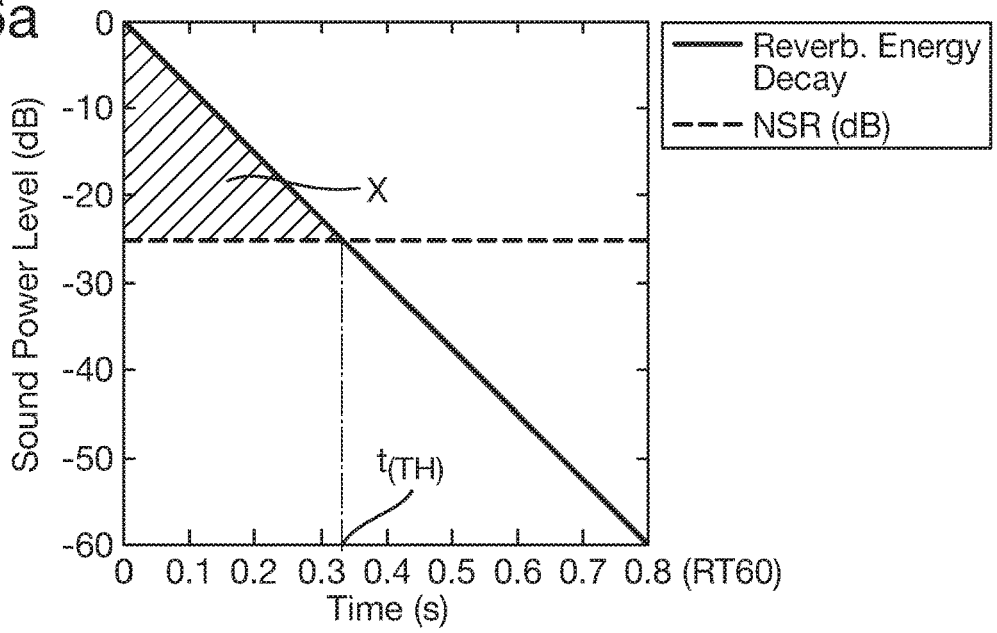
FIGS. 6*a* and 6*b* each provide a graphical representation of the level of reverberant sound in a given acoustic space as well as the level of noise in the acoustic space.
Figure 6B:
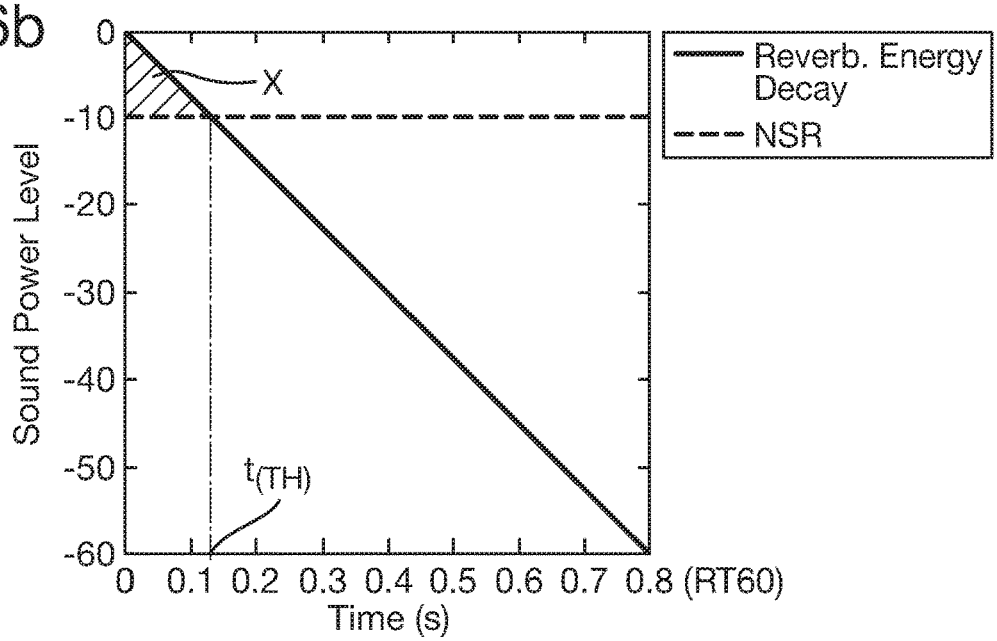

FIGS. 6*a* and 6*b* each provide a graphical representation of the power of reverberant sound in a given acoustic space as well as the level of noise in the acoustic space. Specifically, FIG. 6*a* illustrates these two variables in a low noise scenario, whilst FIG. 6*b* illustrates a high noise scenario.

The graphical representation of the power of the reverberant sound component represents the time taken for the sound power level to decay by 60 dB—i.e. the reverberation time or RT60. At any given time a ratio of the level of reverberant sound energy to the NSR can be determined. According to at least one example of the present aspects the portion length determination unit is operable to determine a threshold time $t_{TH}$ after the level of the reverberant energy falls below a predetermined value relative to the level of the noise (which may be represented by NSR). Thus, the threshold time can be considered to be the time at which the ratio of the level of reverberant sound energy to the level of the NSR is at or above a predetermined value.

The number of samples of the input signal to be passed to the reverberation coefficient determination unit 150 may then calculated based on the threshold time $t_{TH}$.

According to one or more examples the threshold time is set to be the time at which the level of the energy of the decaying reverberant sound is substantially equal to the level of the NSR (noise to signal ratio). At this time, and bearing in mind that dB is a logarithm and that when taking ratios of logarithms x/x=0, the threshold time can be considered to be the time at which a threshold ratio $R_{TH}$ of the level of reverberant sound energy to the level of the NSR is at zero. Thus, a signal processing circuit according to at least one example comprises a determination unit configured to determine a number of samples that will maintain or achieve a positive reverberant sound energy to NSR level ratio.

Depending on the particular requirements of the system, it will be appreciated that the threshold ratio $R_{TH}$ may be set to be a value other than 0 and may, for example, be greater than 0.

This is illustrated in FIGS. 6*a* and 6*b* as the time at which the plot of the power of reverberant sound with respect to time intersects the plot of the NSR. In the low noise scenario illustrated in FIG. 6*a* the threshold time is around 0.33 s. In the high noise scenario illustrated in FIG. 6*b* the $t_{TH}$ is around 0.13 s. Thus, the portion length adjustment mechanism is operable to adjust the portion length L based on the threshold time in order that samples that are saturated by background noise are not included in the input signal that is passed to the reverberation coefficient determination unit.

This can be represented mathematically by:

$$L_{buffer} = \frac{t_{TH} f_s}{N_b}, \tag{10}$$

where $L_{buffer}$ is the buffer length or the number of samples in the buffer, $f_s$ is the sample rate and $N_b$ is the frame size.

According to at least one example the threshold time may be used to derive a number of blocks or frames of the input signal that is to be passed to the reverberation coefficient determination unit.

It will be appreciated that the number of samples need not always be determined on a one to one basis with respect to the threshold time and that other correlations between the number of samples (amount of data) and the threshold time (and thus the threshold ratio) may be applied.

The shaded area X therefore represents the represents the reverberant samples that are likely to have a positive reverberant energy level to noise level ratio and which are therefore input to the reverberation coefficient determination unit 150. It will be appreciated that the shaded area represents samples that having a higher energy than the noise with respect to the speech. Thus, below the level of the NSR the reverberant components are saturated by noise. As such, embodiments of the present example advantageously allow the effective buffer length and/or number of samples to be adjusted based on the level of background noise in order that samples that are saturated or overpowered by the background noise level are preferably not included in the input signal that is passed to the reverberation coefficient determination unit. Thus, preferred examples of the present aspects derive a number of samples to be input to the reverberation coefficient determination unit that will advantageously maintain or achieve a positive reverberation energy level to noise level ratio.

The present examples advantageously allow the input to the dereverberation system to be "tuned" based on a consideration of SNR and also on a consideration of the room impulse response (in particular the reverberation time RT60 derived from the RIR). This allows a more adaptive and bespoke approach to dereverberation which has demonstrated improvements in the performance and/or accuracy of ASR systems which utilise a signal derived from or processed by a dereverberation unit.

According to one or more examples, the determination unit is operable to determine a number of samples of the input signal i.e. an amount of data to be passed to the reverberation coefficient determination unit that will maintain or achieve a positive reverberant energy level to noise level ratio.

Examples of the present aspects can be considered to be performed using a sub band scheme—in that processing is performed independently within each frequency bin k—to allow for frequency dependent noise and reverberation profiles. Thus, examples may benefit from a particular improvement in the quality of low frequency speech signals obtained following the dereverberation process where the issues of speech suppression are more acute.

Figure 7:
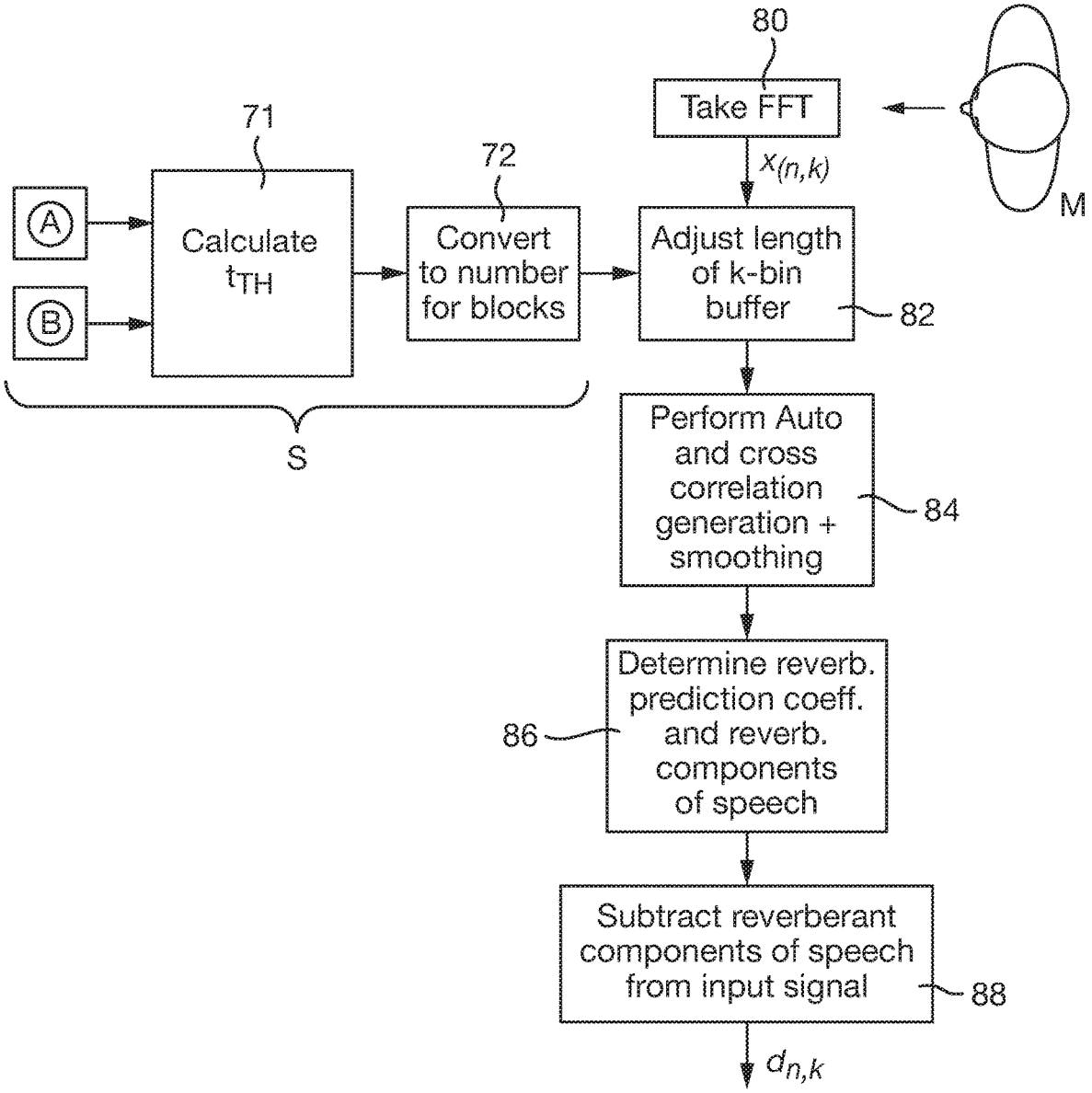
FIG. 7 is a flow diagram illustrating a processing method according to one example of the present aspects.

FIG. 7 is a flow diagram illustrating a processing method according to one example of the present aspects. Initially at step 80 a Fourier Transform is performed on an acoustic signal generated by a microphone M in response to an incident acoustic stimuli. A delay is applied (not shown) to give an input signal x(n, k). The input signal is passed to a frequency bin buffer. At step 82 the length of the buffer is selected/adjusted based on a number of samples that is determined by a sub-process S. The sub-process involves, at step 71, calculating a threshold time $t_{TH}$ based on first and second control inputs A and B. The first control input comprises a representation of the reverberation time for the acoustic space. For example, this may be estimated using blind estimation techniques or non-intrusive estimation based on prediction from the filter coefficients of the adaptive echo cancellation in a prior block. The second control input comprises a long term estimate of the SNR. This may be obtained, for example, from a speech presence probability estimation circuit used to control the step size of one or more adaptive filters of a noise reduction section in prior circuitry blocks. The speech presence probability SPP may be obtained using minimum controlled recursive averaging MCRA and decision directed methods.

According to the present example the calculation of the threshold time involves determining the time at which the reverberant to noise power ratio is approximately zero. At step 72 the threshold time is converted to a number of samples/blocks/frames and, at step 82, the buffer adjusted or selected accordingly based on the number of samples which correspond to the determined threshold time. At step 84 the portion of the input signal that is output from the buffer is subjected to correlation techniques which may involve auto correlation and/or cross correlation of the output. At step 86 reverberation coefficient are estimated, for example using a linear prediction algorithm or auto-correlation technique, based on statistical models of speech.

FIG. 8 is a block diagram illustrating a processing system for carrying the method illustrated in FIG. 7. An electrical input signal generated in response to an acoustic stimuli detected by a microphone M is passed to a Fast Fourier Transform (FFT) block 30 which is operable to determine the amplitude of the microphone signal in each of several frequency ranges or bins. The system comprises a first node X at which the signal line is branched into first, second and third branches. On a first branch the signal is passed to a delay unit 40 which applies a predetermined delay to the input signal. The delay applied by the delay unit 40 may be, for example 32 ms, or may be some other amount of delay. The signal is passed to a buffer 41 which may for example take the form of a circular buffer having an area of memory to which data is written, with that data being overwritten when the memory is full. According to this example the buffer 41 is an adjustable length buffer wherein the buffer length e.g. number of frames or data samples that may be written to the buffer, can be selected. The selected buffer length is calculated by a determination unit 130. As previously described, the determination unit 130 is configured to derive determine a number of samples of the input signal to be passed to the reverberation coefficient determination unit, based on:

i) information about the background noise in the acoustic space; and ii) information about energy of reverberant sound in the acoustic space The amount of data or number of samples of the input signal that are to be provided to the reverberation coefficient determination unit 150 depends, in this example, on the effective buffer length that is selected for the variable buffer 41. The buffered portion of the input signal is subject to known correlation techniques. Specifically, in this example, at unit 170 the delayed buffered samples are cross correlated with the non-delayed input signal which is passed via a third branch. Furthermore, at unit 180 the buffered sample is cross correlated with itself. The correlated signals are input to the reverberation coefficient determination unit 150 which is configured to determine one or more reverberation coefficients based on the buffered sample. The reverberation coefficients directly represent the inverse filter and are applied at to the buffered vector of previous samples to estimate the reverberation component of the respective frequency bin. The reverberant component of that respective frequency bin is then subtracted from the input signal to give a dereverberated signal $d_{n,k}$.

Figure 9:
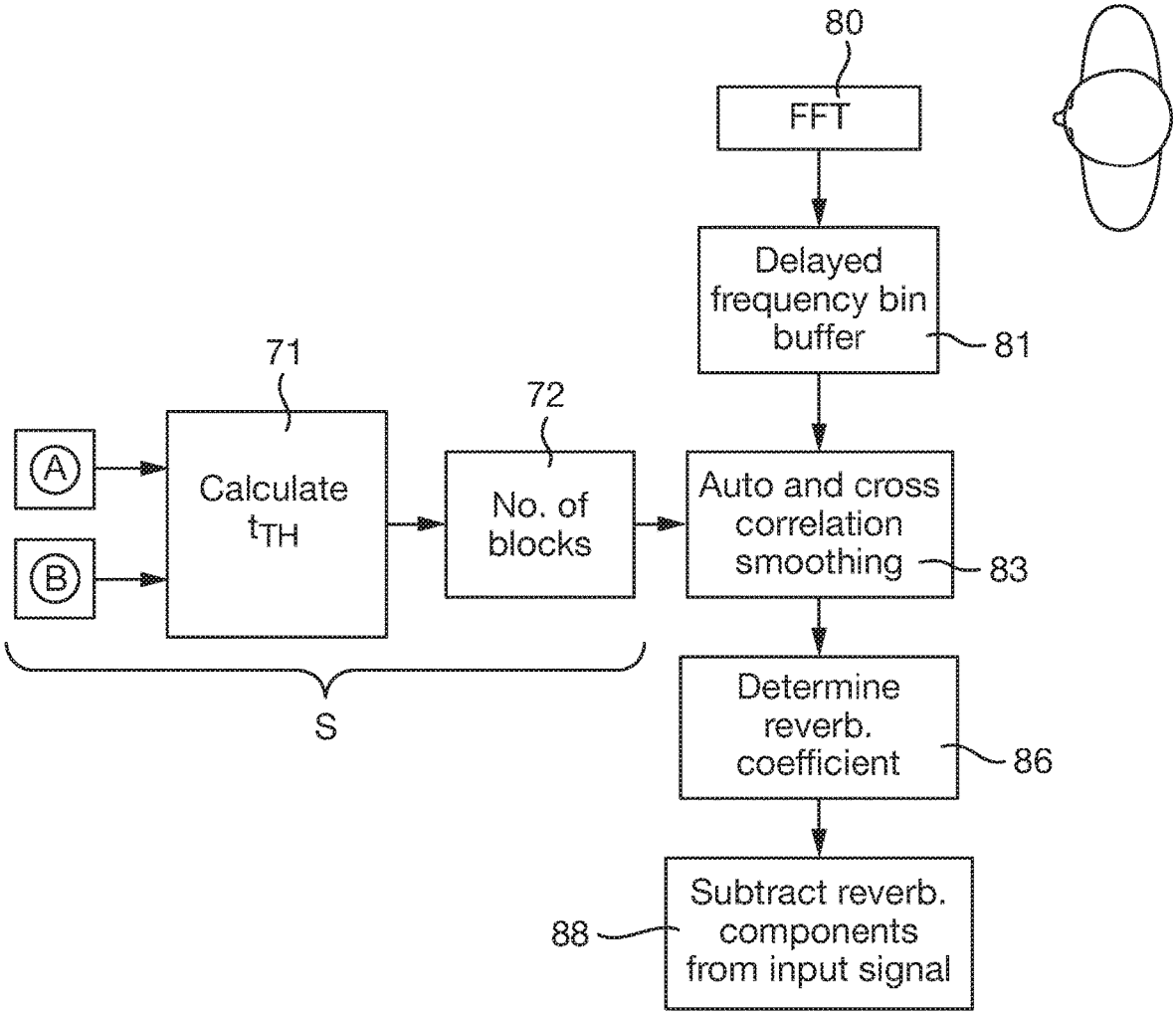
FIG. 9 is a flow diagram illustrating a processing method according to a further example of the present aspects.
Figure 10:
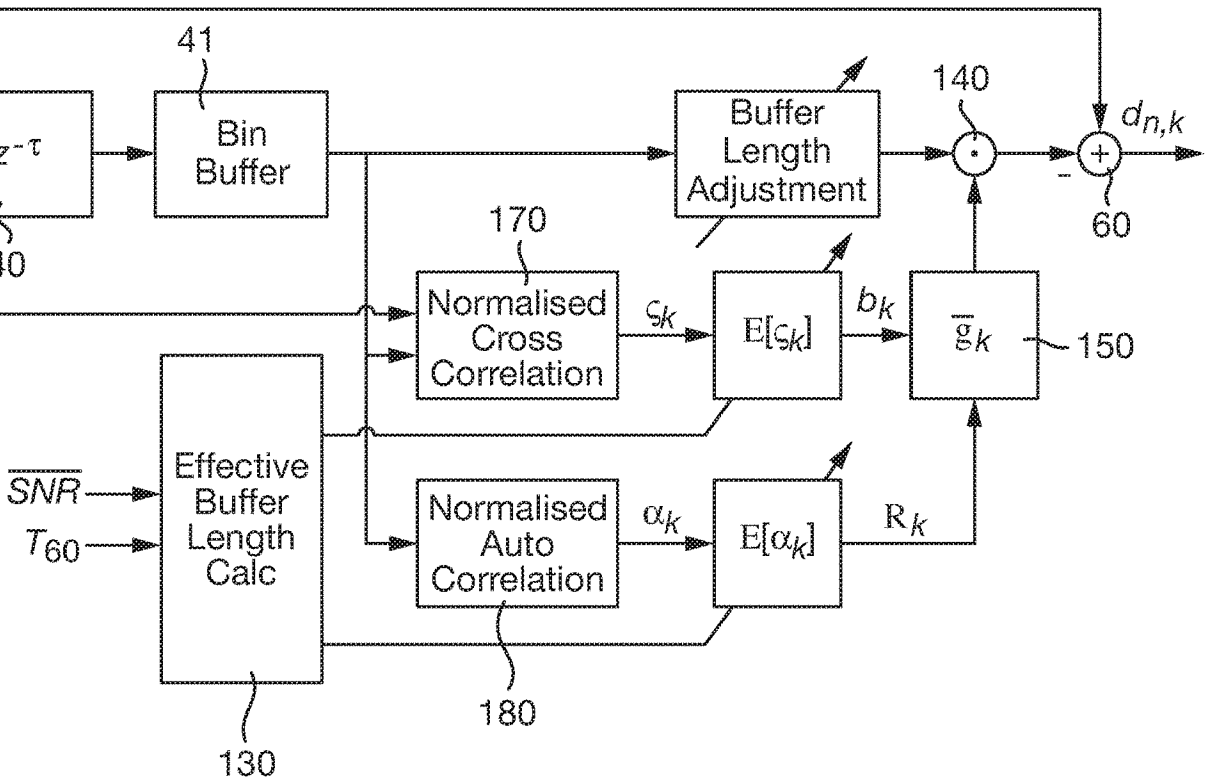
FIG. 10 is a block diagram illustrating a processing system for carrying the processing method illustrated in FIG. 9.

FIG. 9 is a flow diagram illustrating a processing method according to a further example of the present aspects whilst FIG. 10 is a schematic illustration of a processing system for carrying the method illustrated in FIG. 9. The processing method is similar to the process steps illustrated in FIG. 7 except that the buffer 42 comprises a fixed length buffer. Therefore, rather than adjusting the amount of data that can be stored in the buffer, an adjustment is made to amount of data or number of samples that are processed by the correlation units 170 and 180. It will be appreciated that size of the vectors or the cross correlation and the auto correlation are directly proportional to the input buffer. In this example everything up until this point is calculated with the maximum buffer size that corresponds to a maximum reverberation time (e.g. 800 ms) that the system should be able to operate in. This corresponds to a maximum buffer size given by $$L_{max} = \frac{800 \times f_s}{N_b}$$

where $N_b$ is the frame size and $f_s$ is the sample rate. The size of the vectors of the cross correlation and auto correlation are directly proportional to the maximum buffer size $L_{max}$. The expected value of the auto and cross correlations $E[\alpha_k]$ of size $(L_{max} \times L_{max})$ and $E[\varsigma_k]$ of size $(L_{max} \times 1)$ are hence calculated with exponential averaging to get a smoothed output. At this point, the length determined by block 72 in frames $L_{variable}$ is used to adjust the size of $E[\alpha_k]$ and $E[\varsigma_k]$ to $(L_{variable} \times L_{variable})$ and $(L_{variable} \times 1)$ respectively.

The skilled person will recognise that some aspects of the above-described apparatus and methods may be embodied as processor control code, for example on a non-volatile carrier medium such as a disk, CD- or DVD-ROM, programmed memory such as read only memory (Firmware), or on a data carrier such as an optical or electrical signal carrier. For many applications examples of the invention will be implemented on a DSP (Digital Signal Processor), ASIC (Application Specific Integrated Circuit) or FPGA (Field Programmable Gate Array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the examples may also be implemented using code running on a field-(re)programmable analogue array or similar device in order to configure analogue hardware.

Note that as used herein the term unit or module shall be used to refer to a functional unit or block which may be implemented at least partly by dedicated hardware components such as custom defined circuitry and/or at least partly be implemented by one or more software processors or appropriate code running on a suitable general purpose processor or the like. A unit may itself comprise other units, modules or functional units. A unit may be provided by multiple components or sub-units which need not be co-located and could be provided on different integrated circuits and/or running on different processors.

Examples may be implemented in a host device, especially a portable and/or battery powered host device such as a mobile computing device for example a laptop or tablet computer, a games console, a remote control device, a home automation controller or a domestic appliance including a smart home device a domestic temperature or lighting control system, a toy, a machine such as a robot, an audio player, a video player, or a mobile telephone for example a smartphone.

It should be noted that the above-mentioned examples illustrate rather than limit the invention, and that those skilled in the art will be able to design many alternative examples without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope.

The invention claimed is:

1. A signal processing circuit of a speech dereverberation system, the signal processing circuit comprising:

a reverberation coefficient determination unit configured to determine one or more reverberation coefficients of a portion of an input signal generated by an acoustic sensor provided in an acoustic space, wherein an inverse filter is obtained from the reverberation coefficients determined by the reverberation coefficient determination unit and wherein the inverse filter is convolved with the portion of the input signal to obtain an estimate of the reverberant component of the portion;

a determination unit operable to determine a number of samples of the portion of the input signal to be passed to the reverberation coefficient determination unit that will maintain or achieve a positive ratio between: i) a level of the background noise in the acoustic space; and ii) a level of energy of reverberant sound in the acoustic space; and a selection mechanism operable to select the number of samples of the input signal to be passed to the reverberation coefficient determination unit based on the number of samples determined by the determination unit.

2. A signal processing circuit as claimed in claim 1, wherein the information about background noise in the acoustic space comprises information about the SNR or NSR and wherein the information about the energy of the reverberant sound comprises the decay in the energy of the reverberant sound in the acoustic space.

3. A signal processing circuit as claimed in claim 2, wherein the information about the energy of reverberant sound is determined from a representation of the room impulse response (RIR) for the acoustic space.

4. A signal processing circuit as claimed in claim 1 wherein the determination unit is operable to determine a threshold time at which a level of the reverberant energy falls below a predetermined value relative to a respective level of the noise.

5. A signal processing circuit as claimed in claim 1 wherein the determination unit is operable to determine a threshold time at which a level of the energy of the decaying reverberant sound is substantially equal to a level of the NSR.

6. A signal processing circuit as claimed in claim 4 wherein the number of samples are calculated based on the threshold time.

7. A signal processing circuit as claimed in claim 1, wherein the selection mechanism comprises an adjustable length buffer.

8. A signal processing circuit as claimed in claim 1, wherein the selection mechanism is operable to cause adjustment of the number of samples that a processed by a correlation unit of the signal processing circuit.

9. A signal processing circuit as claimed in claim 1, wherein the estimate of the reverberant component of the portion is subtracted or deconvolved with the input signal to give a dereverberated signal dn,k.

10. A signal processing circuit as claimed in claim 8, wherein the dereverberated signal is represented by:

$$d_{n,k}=x_{n,k}^{m}-g_k^{H}x_{n-D,k_n}$$

where $x_{n,k}^{m}$ is the observed signal at the acoustic sensor m, and $g_k^{H}x_{n-D,k_n}$ represents late reverberant sound.

11. A signal processing circuit as claimed in claim 1, wherein the reverberation coefficient determination unit determines the reverberation coefficients based on a linear prediction algorithm.

12. A signal processing circuit as claimed in claim 1, further comprising a delay unit configured to apply a delay to the input signal.

13. A signal processing circuit as claimed in claim 1, further comprising an Fast Fourier Transform (FFT) operable to the determine the amplitude of the input signal generated by the acoustic sensor in a plurality of frequency ranges, wherein the reverberation coefficient prediction unit is operable to determine the reverberant coefficients in one or more of the frequency ranges.

14. A signal processing circuit as claimed in claim 1, in the form of a single integrated circuit.

15. A device comprising a signal processing circuit according to claim 1, wherein the device comprises a mobile telephone, an audio player, a video player, a mobile computing platform, a games device, a remote controller device, a toy, a machine, or a home automation controller, a domestic appliance or a smart home device.

16. A signal processing circuit as claimed in claim 5 wherein the number of samples are calculated based on the threshold time.

17. A method of signal processing comprising:

a) determining one or more reverberation coefficients of a portion of an input signal generated by an acoustic sensor provided in an acoustic space, wherein an inverse filter is obtained from the reverberation coefficients determined and wherein the inverse filter is convolved with the portion of the input signal to obtain an estimate of the reverberant component of the portion;

b) determining a number of samples of a portion of an input signal generated by an acoustic sensor provided in an acoustic space that will maintain or achieve a positive ratio between: i) a level of background noise in the acoustic space; and ii) a level of energy of reverberant sound in the acoustic space; and c) selecting the number of samples of the input signal to be passed to a reverberation coefficient determination unit based on the number of samples determined by the determination unit.

* * * * *